US009638492B2

(12) United States Patent
Jones

(10) Patent No.: US 9,638,492 B2
(45) Date of Patent: May 2, 2017

(54) ELECTRONICALLY ILLUMINATED OPEN SIGHT FOR HANDGUNS AND RIFLES

(71) Applicant: Rene Henry Jones, Tamarac, FL (US)

(72) Inventor: Rene Henry Jones, Tamarac, FL (US)

( * ) Notice: Subject to any disclaimer, the term of this patent is extended or adjusted under 35 U.S.C. 154(b) by 0 days.

(21) Appl. No.: 15/008,258

(22) Filed: Jan. 27, 2016

(65) Prior Publication Data

US 2017/0016697 A1 Jan. 19, 2017

Related U.S. Application Data

(60) Provisional application No. 62/191,647, filed on Jul. 13, 2015.

(51) Int. Cl.

| | |
|---|---|
| ***F41G 1/467*** | (2006.01) |
| ***F41G 1/34*** | (2006.01) |
| ***F41G 1/01*** | (2006.01) |
| *F41G 11/00* | (2006.01) |

(52) U.S. Cl.

CPC ..... *F41G 1/345* (2013.01); *F41G 1/01* (2013.01); *F41G 11/003* (2013.01)

(58) Field of Classification Search

CPC ... F41G 1/345; F41G 1/02; F41G 1/06; F41G 1/467; F41G 1/44

USPC ..... 42/132; 124/87; 33/265

See application file for complete search history.

(56) References Cited

U.S. PATENT DOCUMENTS

| | | | | |
|---|---|---|---|---|
| 4,177,572 | A * | 12/1979 | Hindes | F41G 1/467 33/265 |
| 6,199,286 | B1 * | 3/2001 | Reed, Jr. | F41G 1/467 124/87 |
| 6,493,951 | B1 * | 12/2002 | Smith | F41G 1/467 124/87 |
| 6,681,676 | B2 * | 1/2004 | Hayes | B63C 9/26 42/51 |
| 6,796,037 | B1 * | 9/2004 | Geffers | F41G 1/467 124/87 |
| 7,159,325 | B2 * | 1/2007 | Rager | F41G 1/467 124/87 |
| 7,503,122 | B2 * | 3/2009 | Afshari | F41G 1/467 124/87 |
| 7,631,433 | B2 * | 12/2009 | Labowski | F41G 1/467 124/87 |
| 2003/0019118 | A1 * | 1/2003 | Wilson | F41G 1/467 33/265 |
| 2005/0252064 | A1 * | 11/2005 | Williamson, IV | F41G 1/44 42/123 |
| 2007/0009860 | A1 * | 1/2007 | Young | F41G 1/34 434/21 |

* cited by examiner

*Primary Examiner* — Michael David

(57) ABSTRACT

An electronically illuminated open sight for handguns and rifles utilizes one or more light-emitting diodes to illuminate fiber optic rods held within rid compartments within a plurality of sight posts, including a front sight post and a rear sight post. Each fiber optic rod is viewable through a rod viewing port in the rear surface of each housing, making the illuminated fiber optic rods viewable only to the user of the handgun or rifle. The LEDs are housed within a sight body or control housing and fiber optic cables are run from the LEDs to the fiber optic rods in order to transfer light from the LEDs to the fiber optic rods within the sight posts. The LEDs can be switched on or off by a power switch, and a potentiometer controls the intensity of the LEDs.

13 Claims, 6 Drawing Sheets

ELECTRONICALLY ILLUMINATED OPEN SIGHT FOR HANDGUNS AND RIFLES

The current application claims a priority to the U.S. Provisional Patent application Ser. No. 62/191,647 filed on Jul. 13, 2015.

FIELD OF THE INVENTION

The present invention relates generally to firearms. More particularly, the present invention relates to adjustable illuminated sights for handguns and rifles for use in normal and low-light situations.

BACKGROUND OF THE INVENTION

About 70 percent of all shootings occur in low light situations. Because of low light environments, shooters have a hard time sighting in the target to place a well-aimed shot into the target. In fact, in the most serious consequences a tragic mistake is made, a bystander is wounded or a fatal accident occurs. Sights that are currently on the market do not produce enough light to obtain a proper sight picture, as they are filled with gas to achieve their light intensity. Gas filled night sights slowly lose their intensity to the point of being useless as a night sight, and during this illumination loss period, the dimmed sights could lead the operator to being harmed. Gas filled night sights are fragile and the gas comprises radioactive poisonous gas. If the vial is broken, this gas is a serious health hazard. Manufacturing of these gas night sights are dangerous to factory assemblers as well. Current sights also do not have parts that may be purchased off the shelf for light repair which results in gas night vision sights being irreparable once damaged. These sights do not accommodate rifles, since rifles do not have both rear and front light up sights.

The present invention serves to solve all these issues and provide a safer, more effective alternative to the current sights available to gun owners. The present invention comprises a front sight, a rear sight, and a neck. The present invention utilizes a higher intensity front and rear sight that provides a clearer picture, even when in total darkness. The present invention is battery powered, allowing the user to easily carry out light output power adjustments maintenance and avoid loss of sight visibility in low lighting situations. The present invention comprises non-hazardous illumination components that are safe to manufacture, assemble, and replace. The present invention comprises controllable power settings which allows the user to save the battery power and remain unseen. The present invention is also not limited to guns but rifles as well.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

The present invention is a front and rear sight for handguns and rifles that enables the user to adequately view the front and rear sight in low-light situations, utilizing light and fiber optics to illuminate the sights. The present invention utilizes light-emitting diodes (LEDs) to illuminate fiber optic rods 14 within the sights, with the light being carried from the LEDs 3 to the fiber optic rods 14 by fiber optic cables 2. The present invention is presented in two embodiments—a first embodiment for handguns, and a second embodiment for rifles.

Figure 1:
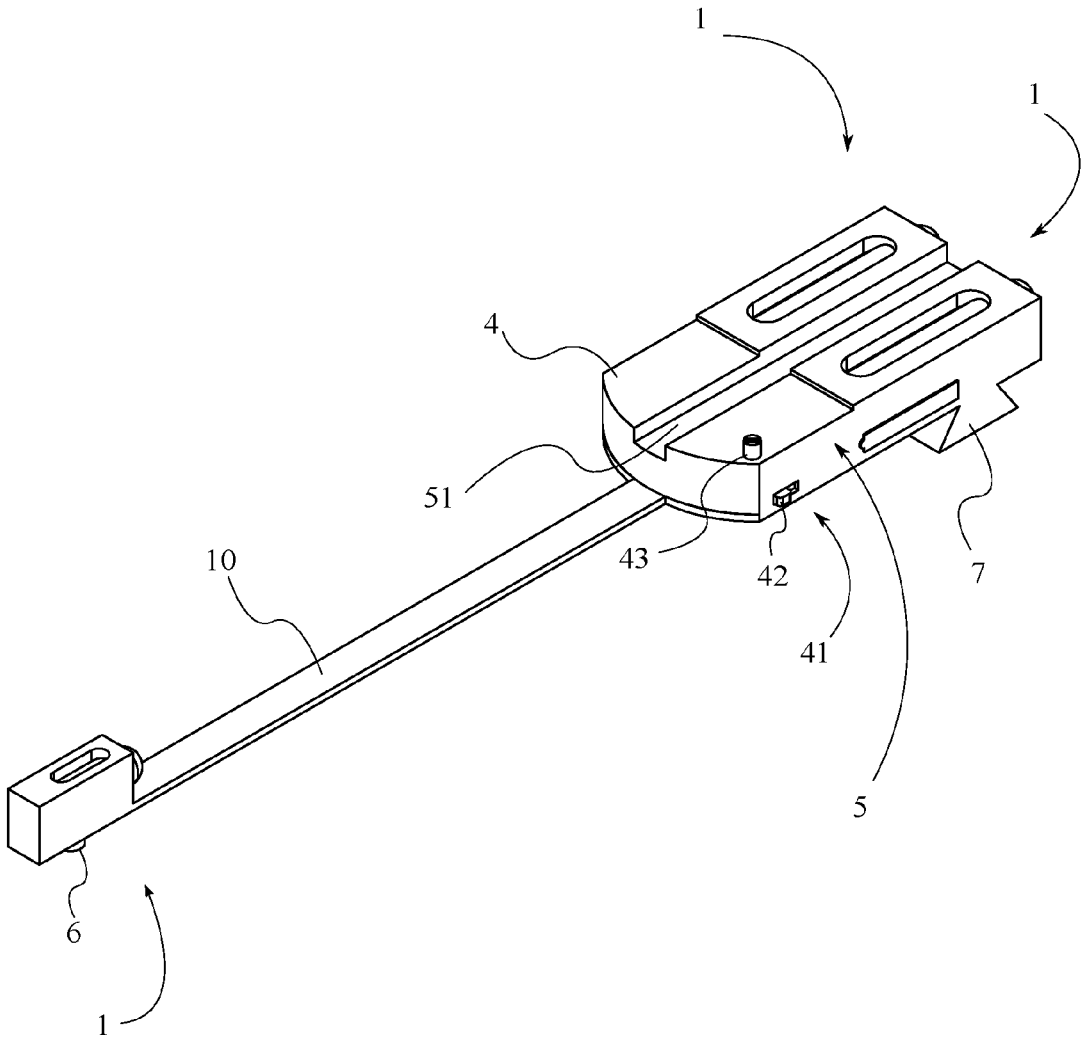
FIG. 1 is an elevated front perspective view of the handgun embodiment of the present invention.
Figure 2:
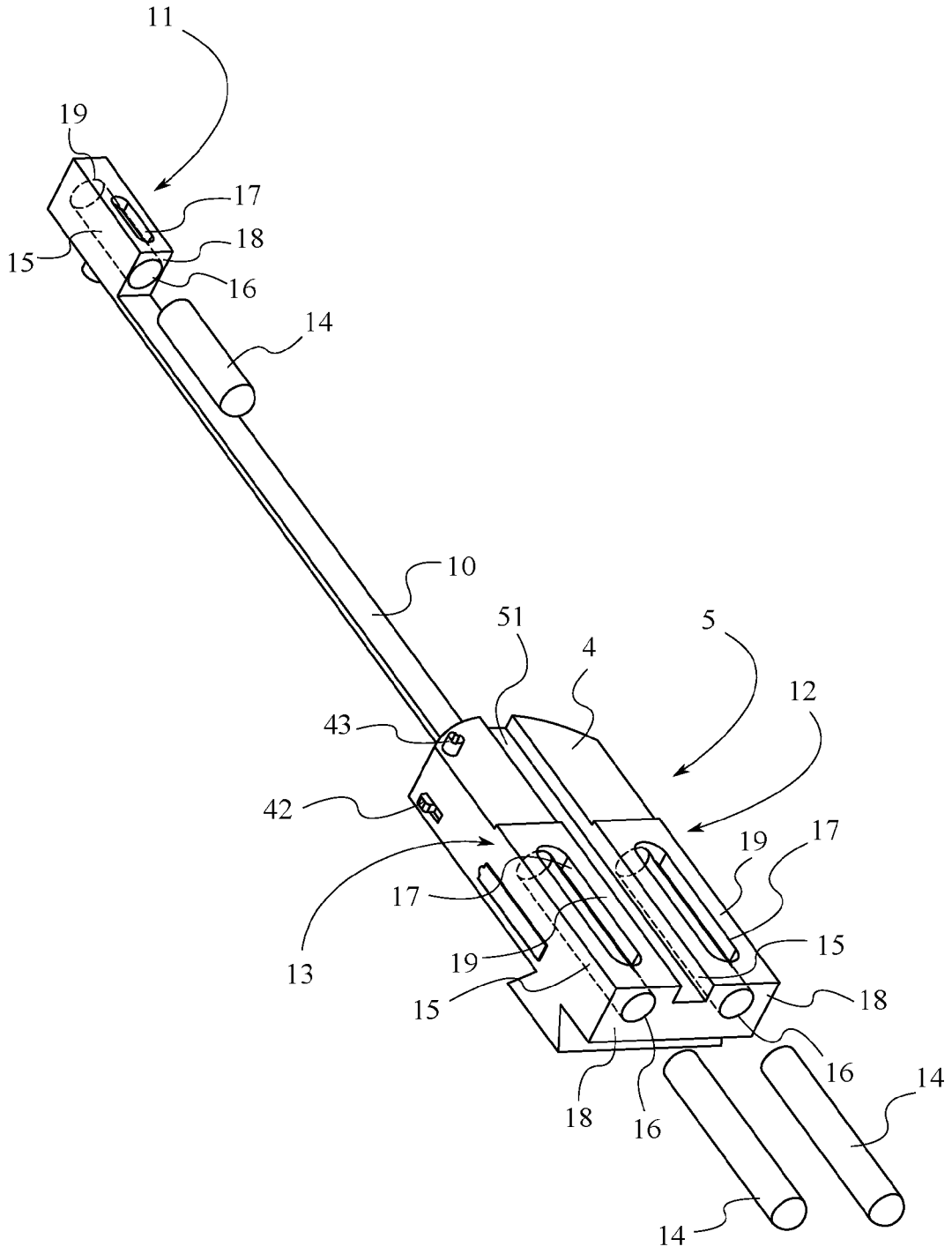
FIG. 2 is an elevated rear perspective exploded view of the handgun embodiment of the present invention.

Referring to FIGS. 1-2, the present invention generally comprises a plurality of sight posts 1, a plurality of fiber optic cables 2, at least one light-emitting diode (LED) 3 or other non-gaseous light source, a control housing 4, a rear sight body 5, a front sight mount 6, a rear sight mount 7, and a power source 8. The power source 8 is electrically connected to the Led control 41 and each of the at least one LED 3.

The plurality of sight posts 1 comprises a front sight post 11, a first rear sight post 12, and a second rear sight post 13. The front sight post 11 is the entirety of the front sight of the present invention, while the first rear sight post 12 and the second rear sight post 13 along with the rear sight body 5 form the rear sight of the present invention. The front sight and the rear sight are attached to a handgun, rifle or other relevant weapon or other tool as is typical with firearm sights, above the barrel of the firearm, and in line with each other.

The first rear sight post 12 and the second rear sight post 13 are connected atop the rear sight body 5. The rear sight body 5 comprises a viewing slot 51. The viewing slot 51 is positioned between the first rear sight post 12 and the second rear sight post 13, allowing the user to look between the first rear sight post 12 and the second rear sight post 13 in order to see the front sight post 11, and align the front and rear sights in order to aim for a shot, as is typical with firearm sights. The viewing slot 51 traverses longitudinally along the rear sight body 5 as far as is necessary to produce the aforementioned effect. The first rear sight post 12, the second rear sight post 13 and the viewing slot 51 are all oriented parallel to each other, and longitudinally, on the rear sight body 5. The longitudinal direction refers to the direction the barrel of whatever firearm the present invention is to be attached to is oriented. The first rear sight post 12 and the second rear sight post 13 are positioned symmetrically about the viewing slot 51, wherein the first rear sight post 12 and the second rear sight post 13 are laterally separated by the viewing slot 51.

As shown in FIG. 2, the rear sight mount 7 is connected to a bottom surface 52 of the rear sight body 5. The rear sight mount 7 may be any useful apparatus or object suitable for attaching the present invention to a firearm, but in the preferred embodiment of the present invention the rear sight mount 7 is a dovetail mount or a picatinny mount. Other applicable means may be utilized for the rear sight mount 7, such as, but not limited to, at least one screw, latch, or another type of fastener or fastening mechanism. In a similar manner, the front sight mount 6 is connected to a bottom surface 111 of the front sight post 11. The front sight mount 6 may be any suitable and useful apparatus or object for attaching the front sight post 11 to a firearm, such as, but not limited to, a dovetail mount, a picatinny mount, or at least one screw, latch, or another type of fastener or fastening mechanism. In every embodiment, the bottom surface 52 of the rear sight body 5 and the bottom surface 111 of the front sight post 11 both comprise a specific barrel accommodating shape in order to correspond to a specific barrel profile of a specific firearm. The nature of the specific barrel accommodating shape will depend on the specific firearm the present invention is manufactured to be specifically used with. In one embodiment, the specific barrel accommodating shape is a flat planar surface in order to accommodate a Glock pistol. In another embodiment, the specific barrel accommodating shape is curved in order to accommodate a 1911 model or Desert Eagle model pistol, or other pistols with rounded top barrel surfaces. Any other specific barrel accommodating shapes may be comprised in order to accommodate any other type of pistol, rifle or other firearm.

In reference to FIG. 2, each of the plurality of sight posts 1 comprises a fiber optic rod 14, a rod compartment 15, a rod viewing port 16, an ambient light slot 17, a rear surface 18 and a top surface 19, wherein the rear surface 18 and the top surface 19 are oriented perpendicular to each other. The rod compartment 15 is positioned within its respective sight post, and is oriented longitudinally. The fiber optic rod 14 is positioned within the rod compartment 15 for each of the plurality of sight posts 1. Preferably, the rod compartment 15 and the fiber optic rod 14 are both substantially cylindrical in shape, though it is contemplates the rod compartment 15 and the fiber optic rod 14 may have another type of geometry, such as, but not limited to, spherical, triangular, or square. The rod viewing port 16 allows the user an unobstructed view of the fiber optic rod 14 within the rod compartment 15, facilitating the main purpose of the present invention. The rod viewing port 16 traverses through the rear surface 18 adjacent to the rod compartment 15 for each of the plurality of sight posts 1. The rear surface 18 is the end of the sight post which is facing the user while the user aims the weapon. Thus, the rear surface 18 of the front sight post 11 is oriented toward the rear sight, and the rear surface 18 of the first rear sight post 12 and the second rear sight post 13 are oriented away from the front sight post 11. The ambient light slot 17 allows the fiber optic rod 14 to be illuminated even without electrical illumination by allowing any ambient light to directly strike the fiber optic rod 14 when sufficient ambient light is present. The ambient light slot 17 traverses through the top surface 19 adjacent to the rod compartment 15 for each of the plurality of sight posts 1.

Figure 6:
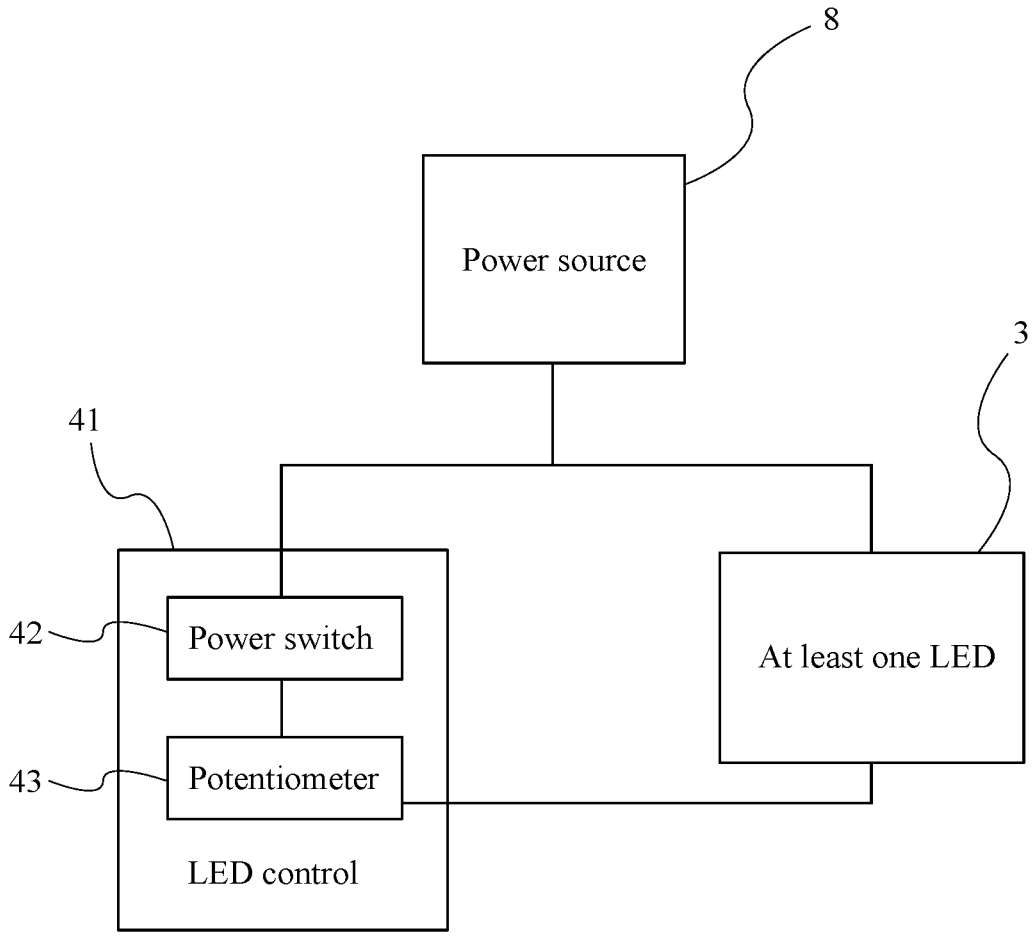
FIG. 6 is a schematic diagram of the electronic components of the present invention.

With reference to FIG. 6, the control housing 4 comprises an LED control 41. In the preferred embodiment, the Led control 41 comprises a power switch 42 and a potentiometer 43. The power switch 42 is used to turn the illumination of the sights on or off, and the potentiometer 43 is used to modulate the amount of electrical power applied to the LED(s) 3, and thus the brightness of the fiber optic rods 14. In the preferred electrical circuit of the present invention, the power source 8 is electrically connected to the power switch 42, the power switch 42 is electrically connected to the potentiometer 43, and the potentiometer 43 is connected to each of the at least one LED 3. Preferably, the aforementioned circuit is wired in series. However, it should be understood that any electrical circuit and components may be utilized to achieve the effects of (1) the ability to turn the electrical flow on or completely off, and (2) control the brightness of light emitted by the fiber optic rods 14. The power source 8 is preferably positioned within the control housing 4, and preferably is a battery. It is contemplated that the battery may be removable, or integrated within the control housing 4 and rechargeable; however, said details are not of paramount importance to the present invention.

Figure 3:
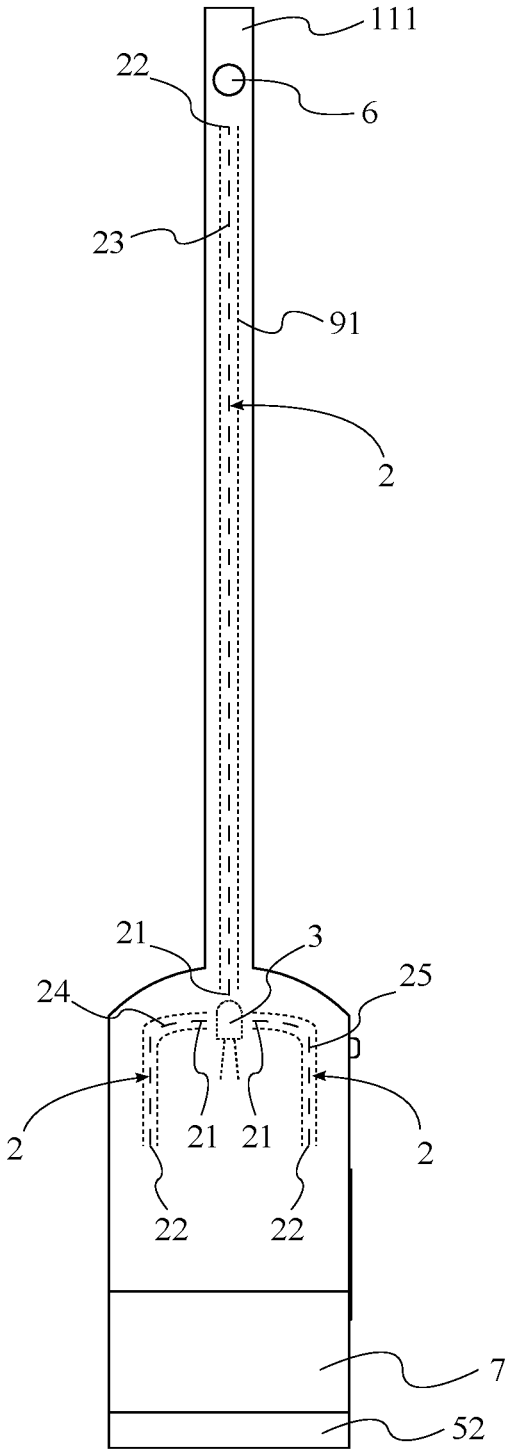
FIG. 3 is a bottom view of the handgun embodiment of the present invention showing internal channels and fiber optic cables.

Referring to FIG. 3, each of the plurality of fiber optic cables 2 comprises an input end 21 and an output end 22. The input end 21 of each of the fiber optic cables 2 is positioned adjacent to one of the at least one LED 3. The output end 22 of each of the fiber optic cables 2 traverses into the rod compartment 15 adjacent to the fiber optic rod 14 of one of the plurality of sight posts 1. Preferably, the output end 22 of each of the fiber optic cables 2 traverses into the rod compartment 15 opposite the rod viewing port 16.

In the first embodiment for handguns shown in FIGS. 1-4, a neck 10 is additionally comprised, connecting the front sight and the rear sight. The neck 10 is laterally aligned with the viewing slot 51 of the rear sight body 5. In one variation of the first embodiment, the control housing 4 is connected adjacent to the rear sight body 5, and the neck 10 is connected between the rear sight body 5 and the control housing 4, thus aligning the front sight post 11 with the viewing slot 51. In this variation, the control housing 4 is positioned between the neck 10 and the rear sight body 5. Preferably, the control housing 4 and the rear sight body 5 form a substantially singular structure, which may be considered to be the rear sight body 5, simply with the electrical components housed within the rear sight body 5. In another variation of the first embodiment, the control housing 4 is a separate structure, connected elsewhere in the present invention. Thus the neck 10 is connected between the front sight post 11 and the rear sight body 5.

In the preferred embodiment of the present invention, each of the fiber optic cables 2 traverses from one of the at least one LED 3 to one of the sight posts 1 within the physical structure or housing of the present invention. In one exemplary embodiment shown in FIGS. 3-4, the rear sight body 5 comprises a first fiber optic channel 91 and a second fiber optic channel 92, and the neck 10 comprises a third fiber optic channel 93. The plurality of fiber optic cables 2 comprises a first fiber optic cable 23, a second fiber optic cable 24, and a third fiber optic cable 25. The at least one LED 3 is positioned within the rear sight body 5.

In reference to FIG. 3, the first fiber optic channel 91 traverses from the at least one LED 3 through the rear sight body 5 and the neck 10 to the rod compartment 15 of the front sight post 11. The second fiber optic channel 92 traverses through the rear sight body 5 from the at least one LED 3 to the rod compartment 15 of the first rear sight post 12. The third fiber optic channel 93 traverses through the rear sight body 5 from the at least one LED 3 to the rod compartment 15 of the second rear sight post 13.

Figure 4:
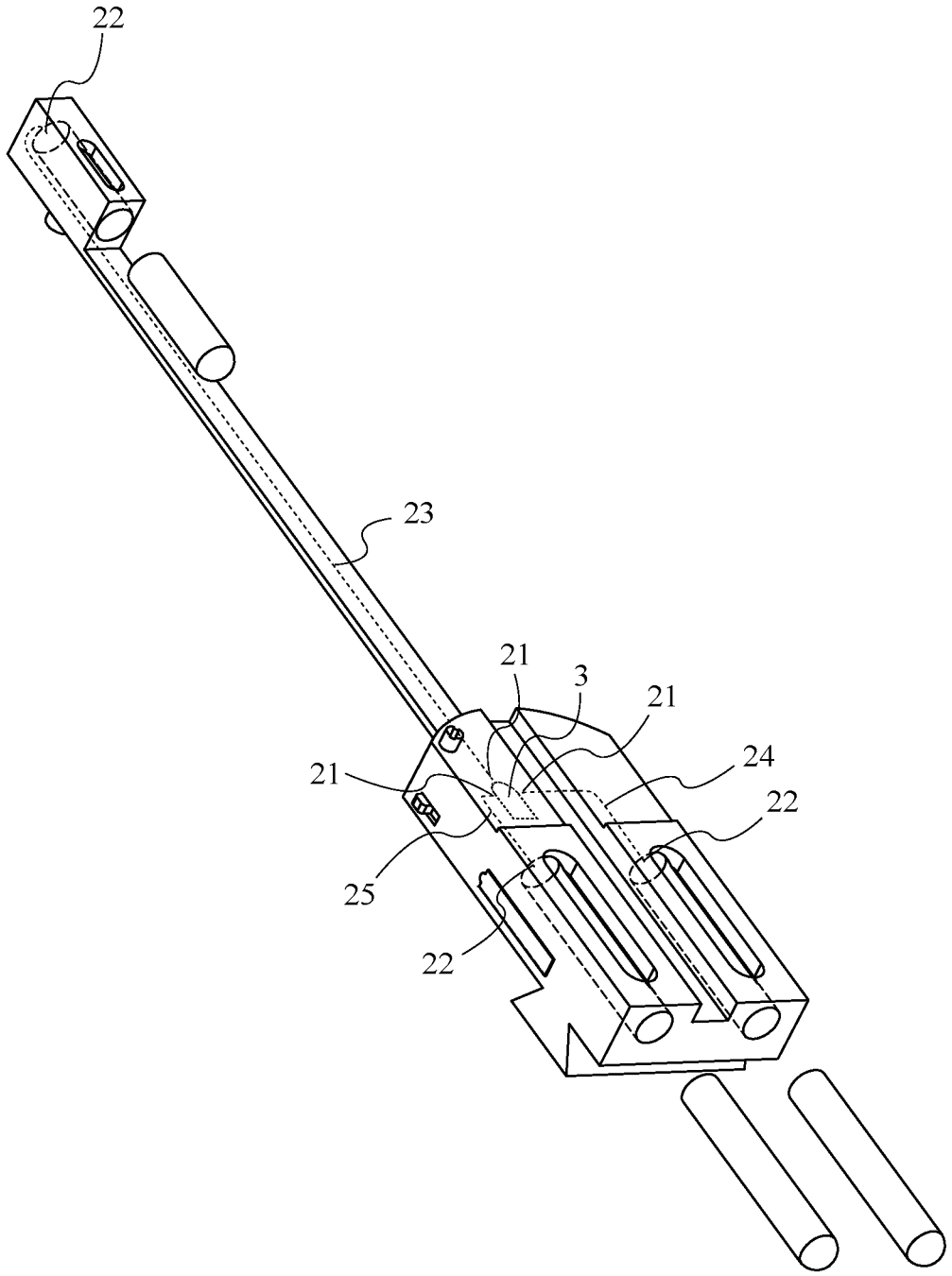
FIG. 4 is an elevated rear perspective exploded view of the handgun embodiment of the present invention showing internal fiber optic cables.

In reference to FIGS. 3-4, the first fiber optic cable 23 is positioned within the first fiber optic channel 91, the second fiber optic cable 24 is positioned within the second fiber optic channel 92, and the third fiber optic cable 25 is positioned within the third fiber optic channel 93. The output end 22 of the first fiber optic cable 23 is positioned adjacent to the fiber optic rod 14 of the front sight post 11, the output end 22 of the second fiber optic cable 24 is positioned adjacent to the fiber optic rod 14 of the first rear sight post 12, and the output end 22 of the third fiber optic cable 25 is positioned adjacent to the fiber optic rod 14 of the second rear sight post 13.

Figure 5:
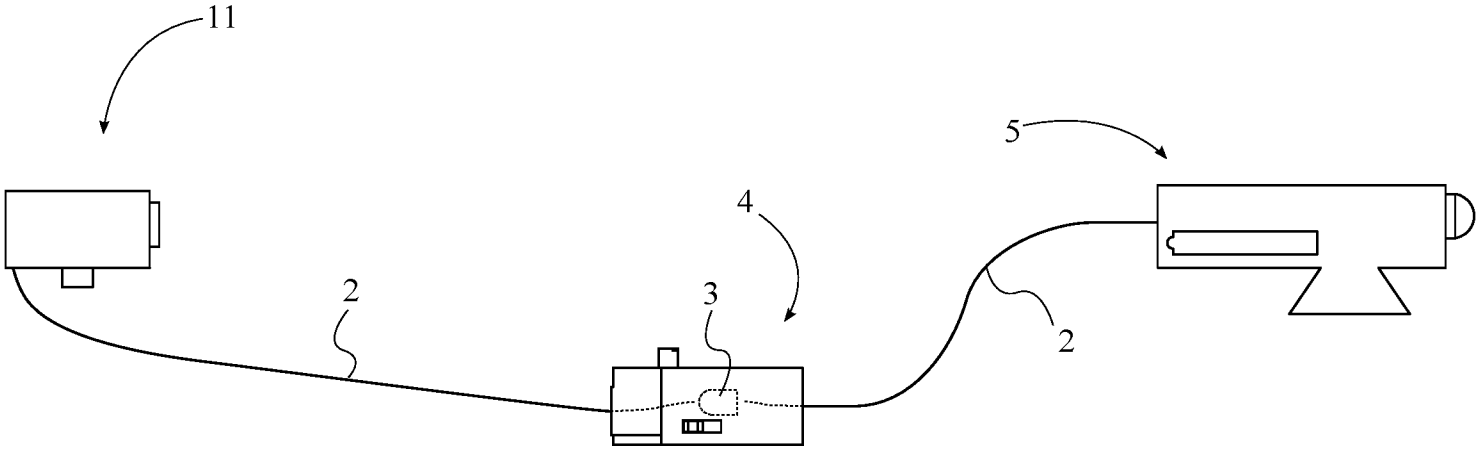
FIG. 5 is a side view of the rifle embodiment of the present invention.

In the second embodiment of the present invention adapted for use with rifles, the neck 10 is not present. The front sight and rear sight are independently attached atop the rifle. In this embodiment, the control housing 4 is also not rigidly attached to either the front sight or rear sight, but is connected to the front sight and rear sight by the fiber optic cables 2 and potentially electrical cable in addition to any tubing or other housing for protecting the fiber optic cables, depending on the number and arrangement of the LEDs 3. For example, in the second embodiment, there may be one or more LED 3 in both or either the front sight and rear sight. In one embodiment, the at least one LED 3 is positioned within the rear sight body 5. In another embodiment shown in FIG. 5, the at least one LED 3 is positioned within the control housing 4. In another embodiment, at least one LED 3 is positioned within the control housing 4, and at least one LED 3 is positioned within the rear sight body 5. The specific arrangement of LEDs 3 is not a detail of paramount importance to the present invention so long as the purpose of illuminating the fiber optics rods is accomplished, and various arrangements may be utilized according to implementation requirements or preferences.

Although the invention has been explained in relation to its preferred embodiment, it is to be understood that many other possible modifications and variations can be made without departing from the spirit and scope of the invention as hereinafter claimed.

What is claimed is:

1. An electronically illuminated open sight for handguns and rifles comprises:

a plurality of sight posts;

a plurality of fiber optic cables;

at least one light-emitting diode (LED);

a control housing;

a rear sight body;

a front sight mount;

a rear sight mount;

a power source;

the plurality of sight posts comprises a front sight post, a first rear sight post, and a second rear sight post;

each of the plurality of sight posts comprises a fiber optic rod, a rod compartment, a rod viewing port, an ambient light slot, a rear surface and a top surface, wherein the rear surface and the top surface are oriented perpendicular to each other;

each of the plurality of fiber optic cables comprises an input end and an output end;

the control housing comprises an LED control;

the rear sight body comprises a viewing slot;

the first rear sight post and the second rear sight post being connected to the rear sight body;

the first rear sight post, the second rear sight post and the viewing slot being oriented parallel to each other on the rear sight body, wherein each of the plurality of sight posts and the viewing slot are oriented longitudinally;

the first rear sight post and the second rear sight post being positioned symmetrically about the viewing slot of the rear sight body, wherein the first rear sight post and the second rear sight post are laterally separated by the viewing slot;

the fiber optic rod being positioned within the rod compartment for each of the plurality of sight posts;

the rod viewing port traversing through the rear surface adjacent to the rod compartment for each of the plurality of sight posts;

the ambient light slot traversing through the top surface adjacent to the rod compartment for each of the plurality of sight posts;

the input end of each of the fiber optic cables being positioned adjacent to one of the at least one LED;

the output end of each of the fiber optic cables traversing into the rod compartment adjacent to the fiber optic rod of one of the plurality of sight posts;

the power source being electrically connected to the LED control and each of the at least one LED;

the front sight mount being connected to a bottom surface of the front sight post; and the rear sight mount being connected to a bottom surface of the rear sight body.

2. The electronically illuminated open sight for handguns and rifles as claimed in claim 1 comprises:

the control housing being connected adjacent to the rear sight body.

3. The electronically illuminated open sight for handguns and rifles as claimed in claim 2 comprises:

a neck;

the neck being laterally aligned with the viewing slot of the rear sight body; and the neck being connected between the control housing and the front sight post.

4. The electronically illuminated open sight for handguns and rifles as claimed in claim 1 comprises:

a neck;

the neck being laterally aligned with the viewing slot of the rear sight body; and the neck being connected between the rear sight body and the front sight post.

5. The electronically illuminated open sight for handguns and rifles as claimed in claim 1 comprises:

the rod compartment and the fiber optic rod being cylindrical; and the rod compartment and the fiber optic rod being oriented longitudinally.

6. The electronically illuminated open sight for handguns and rifles as claimed in claim 1 comprises:

the power source being positioned within the control housing.

7. The electronically illuminated open sight for handguns and rifles as claimed in claim 1 comprises:

the at least one LED being positioned within the rear sight body.

8. The electronically illuminated open sight for handguns and rifles as claimed in claim 1 comprises:

the at least one LED being positioned within the control housing.

9. The electronically illuminated open sight for handguns and rifles as claimed in claim 1 comprises:

the output end of each of the fiber optic cables traversing into the rod compartment opposite the rod viewing port.

10. The electronically illuminated open sight for handguns and rifles as claimed in claim 1 comprises:

the rear sight body comprises a first fiber optic channel and a second fiber optic channel;

the neck comprises a third fiber optic channel;

the plurality of fiber optic cables comprises a first fiber optic cable, a second fiber optic cable, and a third fiber optic cable;

the at least one LED being positioned within the rear sight body;

the first fiber optic channel traversing from the at least one LED through the rear sight body and the neck to the rod compartment of the front sight post;

the second fiber optic channel traversing through the rear sight body from the at least one LED to the rod compartment of the first rear sight post;

the third fiber optic channel traversing through the rear sight body from the at least one LED to the rod compartment of the second rear sight post;

the first fiber optic cable being positioned within the first fiber optic channel;

the second fiber optic cable being positioned within the first fiber optic channel;

the third fiber optic cable being positioned within the third fiber optic channel;

the output end of the first fiber optic cable being positioned adjacent to the fiber optic rod of the front sight post;

the output end of the second fiber optic cable being positioned adjacent to the fiber optic rod of the first rear sight post; and the output end of the third fiber optic cable being positioned adjacent to the fiber optic rod of the second rear sight post.

11. The electronically illuminated open sight for handguns and rifles as claimed in claim 1 comprises:

the rear sight mount being a dovetail mount.

12. The electronically illuminated open sight for handguns and rifles as claimed in claim 1 comprises:

the rear sight mount being a picatinny mount.

13. The electronically illuminated open sight for handguns and rifles as claimed in claim 1 comprises:

the LED control comprises a potentiometer and a power switch;

the power source being electrically connected to the power switch;

the power switch being electrically connected to the potentiometer; and the potentiometer being connected to each of the at least one LED.

* * * * *